United States Patent [19]

Biancalani

[11] Patent Number: 4,484,399

[45] Date of Patent: Nov. 27, 1984

[54] STEAM IRON WITH REAR WATER RESERVOIR

[76] Inventor: Mauro Biancalani, Via Ida Baccini 11, Firenze, Italy

[21] Appl. No.: 405,593

[22] Filed: Aug. 5, 1982

[30] Foreign Application Priority Data

Jun. 10, 1982 [IT] Italy ..... 11695/82[U]

[51] Int. Cl.[3] ..... D06F 75/14

[52] U.S. Cl. ..... 38/77.3; 38/77.8; D32/68

[58] Field of Search ..... 38/77.1, 77.3, 77.8, 38/77.82; D32/68–72

[56] References Cited

U.S. PATENT DOCUMENTS

| | | | |
|---|---|---|---|
| 2,506,941 | 5/1950 | Scott | 38/77.82 |
| 2,550,825 | 5/1951 | Kolodie | 38/77.8 |
| 3,949,499 | 4/1976 | Schaeffer et al. | 38/77.3 |

FOREIGN PATENT DOCUMENTS

| | | | |
|---|---|---|---|
| 2534701 | 2/1977 | Fed. Rep. of Germany | 38/77.3 |
| 2538243 | 3/1977 | Fed. Rep. of Germany | 38/77.8 |
| 2605443 | 8/1977 | Fed. Rep. of Germany | 38/77.8 |

*Primary Examiner*—Werner H. Schroeder
*Assistant Examiner*—Andrew M. Falik
*Attorney, Agent, or Firm*—Hopgood, Calimafde, Kalil, Blaustein & Judlowe

[57] ABSTRACT

A steam iron including a heated soleplate and a vaporization cavity adjacent the soleplate. A shaped element forms a cowl, a forwardly projecting hollow handle and a rearward connection therebetween. A manifold with at least one manually controlled passageway for the measured delivery of water into the vaporization cavity is disposed above the vaporization cavity. A vertical reservoir is joined to the rearward connection and includes openings for fluid communication with both the handle and the manifold. The reservoir may be filled through the hollow handle.

3 Claims, 1 Drawing Figure

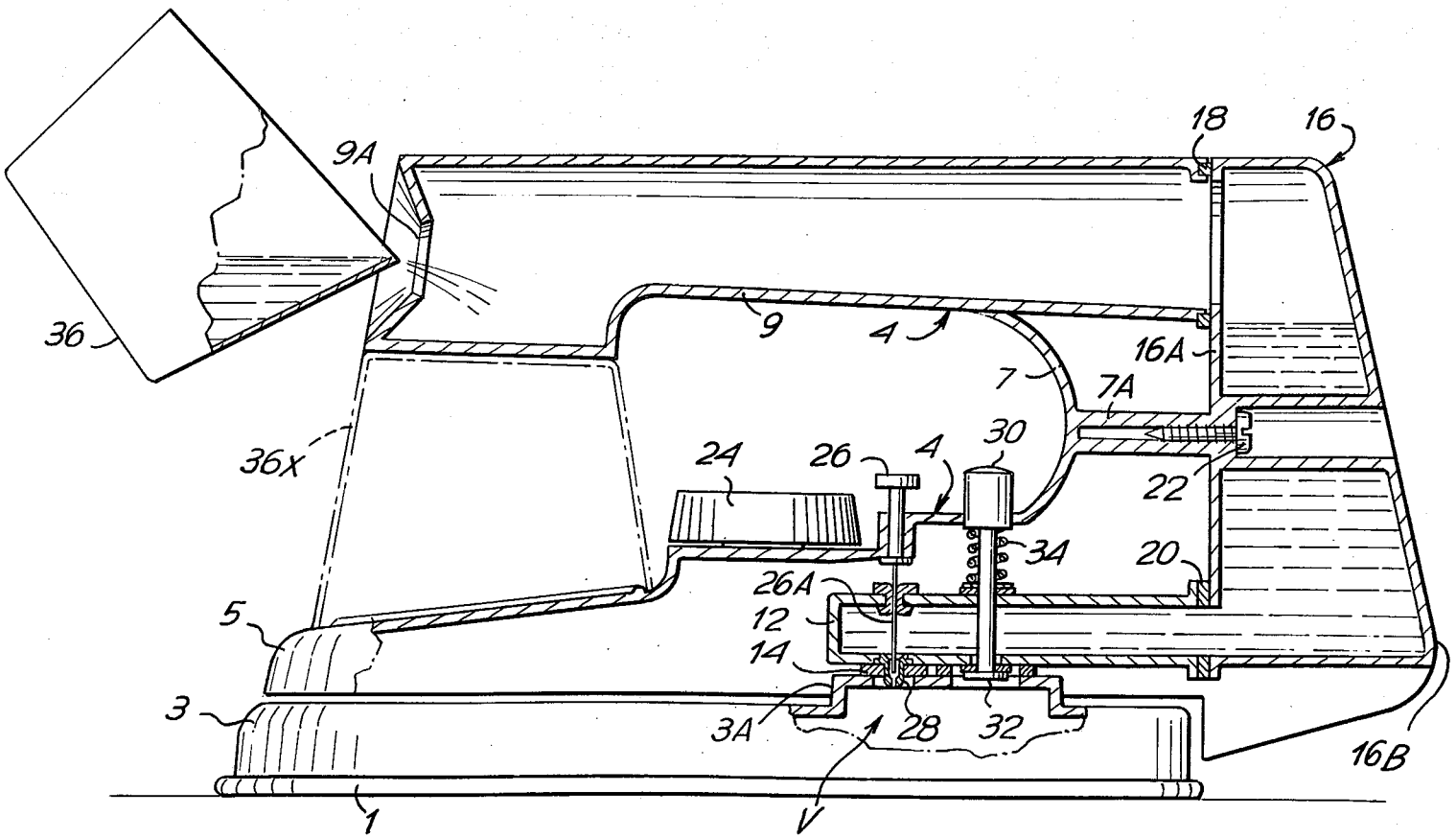
16
18
16A
7A
22
20
16B
7
30
34
32
4
4
28
26
26A
12
14
V
9
24
3A
9A
36X
5
1
3
36

STEAM IRON WITH REAR WATER RESERVOIR

BACKGROUND OF THE INVENTION

This invention relates to an iron for the pressing of fabrics, and particularly, to a steam iron.

SUMMARY OF THE INVENTION

The invention is directed to a steam iron having a heated soleplate, a water reservoir with at least one manually operable passageway for the measured delivery of water into a vaporization cavity adjoining the soleplate, and a handle.

The reservoir is disposed in the rear part of the iron. Specifically, the reservoir is disposed vertically and at the back of a shaped element, which forms a cowl over the soleplate, a forward projecting handle and a rearward connection to which the reservoir is joined.

Advantageously, the reservoir includes a forward wall with openings surrounded by seals, and is joined to the connection with an opening corresponding to the hollow handle and an opening corresponding to a manifold adjoining the rear part of the soleplate. The manifold includes at least one hole with a manually operable obturator for the measured delivery of water into the vaporization cavity. The hollow handle includes a forward opening for the introduction of water.

In practice, the manifold can be connected to the vaporization cavity through either an obturator pin in a connection hole for the measured delivery of water, or by the stem of an obturator for a delivery hole of larger section. The obturators are operable by control members projecting from the rear part of the cowl covering the soleplate, below the handle.

BRIEF DESCRIPTION OF THE DRAWING

The drawing shows a longitudinal section of an embodiment of the invention.

DESCRIPTION OF THE PREFERRED EMBODIMENT

In the drawing, the iron includes a heated soleplate 1, whose lower surface is constructed and arranged to glide over the fabrics to be ironed; a body 3 defines, together with the soleplate 1, a vaporization cavity V adjacent to soleplate 1, and its temperature is such as to assure the vaporization of the limited quantities of water which are delivered to the cavity. Reference numeral 4 indicates a shaped element which forms a cowl 5 covering the unit 1, 3. Cowl 5 is shaped and includes a rearward connection 7 between the lower part forming the cowl and the upper part 9 which constitutes a forward projecting embossed handle. Element 4 comprising parts 5, 7, 9, may be made by a molding of a synthetic resin having suitable thickness. Element 4 forms, or is integral with, a manifold 12, which is disposed above the rear part of the unit 1, 3. Manifold 12 is relatively low and is in contact—through a seal 14—with a projecting part 3A of body 3. The front end of handle 9 includes an opening 9A for the introduction of the water to be vaporized.

At the back, element 4 forms support edges for a water reservoir 16, of which one wall 16A is joined to the rear support edges of element 4 through seals 18 and 20, which encircle fluid communication openings between reservoir 16 and the cavity of the handle 9 and between reservoir 16 and manifold 12. Reservoir 16 is joined by at least one screw 22, engaging into a corresponding bushing 7A formed at the back of element 4. Reservoir 16 includes a rear surface 16B inclined for support of the iron in an approximately vertical position.

A knob 24 serves to adjust a traditional thermostat which is not shown. A control button 26 serves to deliver small quantities of water from the tank—formed by reservoir 16 and by manifold 12—towards vaporization cavity V through a pin 26A, which passes through the manifold and a connection hole 28 disposed between manifold 12 and body 3. By a second control button 30 an obturator 32 is opened, which is normally closed by a counter spring 34, if one desires to introduce a larger quantity of water into cavity V for washing or other purposes. Buttons 26 and 30 are situated below handle 9, on the rear part of cowl 5.

A measuring beaker 36 can be stored between the front part of cowl 5 and the front part of handle 9. Measuring beaker 36 is held elastically in this position, which is indicated by 36X in the drawing. The beaker can be removed and used to pour measured quantities of water into the inside of the steam iron by means of opening 9A. The measuring beaker must be removed during use of the iron, thus leaving open the forward portion of the iron formed by the front portions of pieces 1, 3, 5.

The rearwardly disposed tank formed by reservoir 16 makes the front portion of pieces, 1, 3, 5 less cumbersome and less thick, and therefore, the use of the iron is more convenient. The iron is thus open along the front part and assumes a configuration which is traditional for irons of the type, but the present invention has improved vaporization performance. An iron constructed in accordance with the invention is also more economical than the present types.

I claim:

1. An improved steam iron comprising:

a heated soleplate;

a vaporization cavity, adjacent said soleplate for the vaporization of water introduced thereto;

a shaped element forming a cowl portion above said soleplate, a forwardly projecting hollow handle and a rearward connection between said cowl portion and said handle;

a vertical water reservoir joined to said rearward connection, said forwardly projecting handle being supported at said rearward connection and being free from support at the front to provide an open space between said cowl portion and said handle;

a manifold disposed above said vaporization cavity;

at least one opening between said manifold and said vaporization cavity, manually operable obturator means disposed in said opening for opening and closing said opening, a measured quantity of water being introduced into said vaporization cavity upon activation of said obturator;

said reservoir having a first opening for fluid communication with said handle and a second opening for fluid communication with said manifold whereby said reservoir may be filled through said handle and the water contained in said reservoir is passed to said manifold.

2. The steam iron as claimed in claim 1, further including a second opening between said manifold and said vaporization cavity and a second obturator in said second opening, said second obturator and opening being sized differently from said first opening to permit the introduction of a differing amount of water into said vaporization cavity.

3. The steam iron as claimed in claim 1, wherein the portion of the iron between said cowl and said handle includes means for holding a measuring beaker, said measuring beaker being removable from said holding means to assist in filling of the iron.

* * * * *